US009695746B2

(12) United States Patent
Woods

(10) Patent No.: US 9,695,746 B2
(45) Date of Patent: Jul. 4, 2017

(54) POTENTIAL ENERGY STORAGE ENGINE

(71) Applicant: Ray Fitzgerald Woods, Salem, OH (US)

(72) Inventor: Ray Fitzgerald Woods, Salem, OH (US)

(73) Assignee: Ray F. Woods, Salem, OH (US)

( * ) Notice: Subject to any disclaimer, the term of this patent is extended or adjusted under 35 U.S.C. 154(b) by 168 days.

(21) Appl. No.: 14/708,046

(22) Filed: May 8, 2015

(65) Prior Publication Data

US 2016/0326953 A1 Nov. 10, 2016

Related U.S. Application Data

(60) Provisional application No. 61/990,215, filed on May 8, 2014.

(51) Int. Cl.

| | |
|---|---|
| ***F02B 71/00*** | (2006.01) |
| ***F02B 75/28*** | (2006.01) |
| *F02B 75/30* | (2006.01) |

(52) U.S. Cl.

CPC ..... *F02B 75/28* (2013.01); *F02B 71/00* (2013.01); *F02B 75/285* (2013.01); *F02B 75/30* (2013.01)

(58) Field of Classification Search

CPC ..... F02B 71/00; F02B 75/28; F02B 75/30; F02B 75/285

USPC ..... 123/46 R

See application file for complete search history.

(56) References Cited

U.S. PATENT DOCUMENTS

| | | | | |
|---|---|---|---|---|
| 3,853,100 A * | 12/1974 | Braun | F02B 71/04 | 123/198 DA |
| 9,016,256 B2 * | 4/2015 | Hamby | F02B 33/10 | 123/193.1 |
| 2010/0275884 A1 * | 11/2010 | Gray, Jr. | F01B 7/16 | 123/46 R |

* cited by examiner

*Primary Examiner* — Jacob Amick
*Assistant Examiner* — Charles Brauch

(57) ABSTRACT

The present invention is a linear internal combustion free-piston engine with three acting pistons per combustion chamber, that has the ability to store energy until needed. This engine utilizes a spring to store potential energy after combustion. The present invention also introduces additional air into the combustion chamber during the combustion cycle providing a more complete burn of the fuel, has the ability to self-start, and does not idle. Multiple engines can be married together and run as a single unit.

14 Claims, 7 Drawing Sheets

POTENTIAL ENERGY STORAGE ENGINE

CROSS-REFERENCE TO RELATED APPLICATIONS

This application claims priority from U.S. Provisional Patent Application No. 61/990,215 filed May 8, 2014 with the United States Patent and Trademark Office. The disclosure of which is incorporated herein.

BACKGROUND

1. Field

The present invention relates to combustion engines, more specifically, an internal combustion free-piston engine.

2. Description of Related Art

Conventional internal combustion engines today consume vast amounts of fuel and do not harness the maximum potential of the amount of energy created by combustion. Thus creating a loss of use of the potential energy and wasting fuel. The traditional internal combustion rotary engine relies on the Revelutions Per Minute (RPM) for idle and increasing horsepower and torque. As a four-stroke engine introduces fuel and air into a cylinder, the RPM of the engine directly affects the amount of time the combustion cycle has before it is exhausted from the cylinder. At higher RPMs todays internal combustion rotary engines do not have enough air or time to completely combust the fuel therefore exhausting un-burnt fuel and carbon from the cylinders into the exhaust, creating the necessity of a catalytic convertor for further burning emissions out of the exhaust gases. Pollution has always been an issue when referring to the internal combustion engine along with the excessive amounts of fuel required to power them. These issues have forced humanity to search for cleaner burning and a more abundant renewable fuel source. Even as today's engine operates at idle, waiting to be utilized, it is consuming fuel, therefore wasting fuel. Conventional engines do not have the ability to fluctuate compression when desired nor can they create more torque when required.

Considering prior art, a multiple of different internal combustion engines and methods for controlling the combustion cycle have been invented solving various issues with said conventional engines, for example see U.S. Pat. Nos. 692,218, 4,539,946, 6,722,322, 7,194,989, 7,823,546, 8,215,112, 8,662,029, 8,746,200, 8,757,126, and 8,997,699.

Prior art in U.S. Pat. No. 692,218 is a free-piston explosive engine that consists principally of a valve mechanism for controlling the speed of the engine and regulating the supply of air and fuel to the cylinder as well as an effective means for returning the piston on the return stroke. It also provides a means of making the engine self-starting.

In U.S. Pat. No. 4,539,946 a "Method of Controlling the Combustion Cycle in a Combustion Engine" that regulates the amount of fuel that is drawn into the engine and retains a certain amount to be compressed and used while a portion flows out without being compressed.

U.S. Pat. No. 6,722,322 an "Internal Combustion Engine" issued on Apr. 17, 2002 is an engine having at least one cylinder with two cylinder heads interconnected by one cavity. It states the engine cylinder configuration substantially increases the volume to enhance efficiency.

An "Energy Efficient Clean Burning Two-stroke Internal Combustion Engine" issued Mar. 27, 2007, U.S. Pat. No. 7,194,989 is a precision cast engine having a piston unit and a rotor unit to translate linear thrust from the piston unit into rotary power.

U.S. Pat. No. 7,823,546 entitled "Super Charged Engine" issued Nov. 2, 2010 is an engine with an output shaft extending through the engine block and generally parallel to the piston, the engine includes a boost piston cylinder integral to the cylinder, and a boost piston for producing compressed air so as to supercharge the engine.

A "Free Piston Stirling Engine", U.S. Pat. No. 8,215,112, is a free piston sterling engine comprising a power piston fitted into a cylinder and further includes; a support structure carrying moving magnets for linear alternator; and a passive structure that at normal operating power and frequency produces a restoring force on the piston in the absence of contact with the cylinder.

Another example in U.S. Pat. No. 8,662,029 is a linear combustion engine having a cylinder with a combustion section in the center portion of the cylinder and a pair of opposed piston assemblies adapted to move linearly within the cylinder.

In U.S. Pat. No. 8,746,200 a "Reciprocating Piston Internal Combustion Engine with Mass Balancing Device" relates to a reciprocating-piston internal combustion engine having at least one engine cylinder and piston oscillating therein and having a balancing mass which is driven by a crankshaft.

Issued Jun. 24, 2014, U.S. Pat. No. 8,757,126 is a non-reciprocating piston engine with pistons that follow a circular motion and respective cylinders follow a counter-circular motion relative to the pistons, such that each piston follows a linear path relative to the respective cylinder and at least a top surface of each piston remains within the cylinder throughout engine operation resulting in a stroke length four times the radius of the circular motion.

U.S. Pat. No. 8,997,699 is a linear free piston combustion engine with indirect work extraction via gas linkage having a cylinder with two opposed free pistons disposed therein that form a combustion section in a center of the cylinder with each piston having a front face and back face, where two opposed extractor pistons in their own cylinders at opposite ends of the free piston cylinder and two gas linkages and each extractor piston is connected to a rotary electromagnetic machine.

After acknowledging prior art, it is desirable to provide an engine that overcomes the issues mentioned above that uses less fuel and more completely combusts the fuel creating higher efficiency and less pollution by controlling the length of the combustion cycle. By providing an engine that can utilize various combustible fuels, does not idle, is not rotary, has fewer parts, is more cost effective to manufacture, and harnesses and stores the maximum amount of potential energy until needed, it is evident the efficiency will surpass that of the conventional internal combustion engine; which is currently around 35%-40%. It is also desirable to provide an engine that doesn't require a compression stroke to complete a cycle and stores the energy created by combustion until needed, therefore allowing the engine components to last longer because of less wear and tear and having more time to cool in between cycles.

BRIEF SUMMARY OF THE INVENTION

The present invention is an internal combustion free-piston engine and is laid out in a linear design. The engine is comprised of multiple cylinders with three acting pistons per each combustion chamber. The first cylinder having a head with provisions for air/fuel, spark, and controlled exhaust valve introduction. The combustion chamber is located within the first cylinder and above a first piston being the combustion piston that is affixed to a main shaft. Where the main shaft is also a rack containing an air chamber that has an opening in the top of the combustion piston an opening in the bottom of the main shaft. The air chamber is used for transporting air into the combustion chamber during the combustion cycle. Beneath the combustion piston and inside the main shaft is the air chamber and a second stationary piston, with the air chamber creating a second cylinder interiorly of the first cylinder, so that when combustion takes place, air inside the air chamber is forced up into and out the combustion piston into the combustion chamber. Also located exteriorly to a third cylinder being the oil cylinder is an energy storage device being a spring. The energy storing device can be a compression, torsion, or extension spring. There is at least one energy storing spring per engine and springs can also be arranged in multiples per engine. The stationary piston has a through hole that's' first opening is in its piston head and the distal opening is at its bottom that is open to outside air so that air can be replenished into the air chamber as the combustion piston ascends upward while the spring is utilizing stored energy and forcing the piston toward the head. At the bottom of the main shaft is a third piston being the oiling piston that serves as a positive displacement pump distributing oil throughout the engine during the combustion cycle. As the energy stored from combustion on the spring is required for work, the oiling piston, now moving upward, siphons oil into the oil cylinder. The main shaft also being a rack rotates a pinion affixed to an internal sprag clutch that is affixed to jackshaft extending out of the engine as the combustion piston is thrust downward during combustion; compressing, extending, or torqueing the spring, and the jackshaft is locked via braking system in the downward position until energy is required. As energy is required, the brake system is released and work can be performed. Multiple engines can be run together as one unit on the same drive shaft.

DETAILED DESCRIPTION OF THE INVENTION

Figure 1:
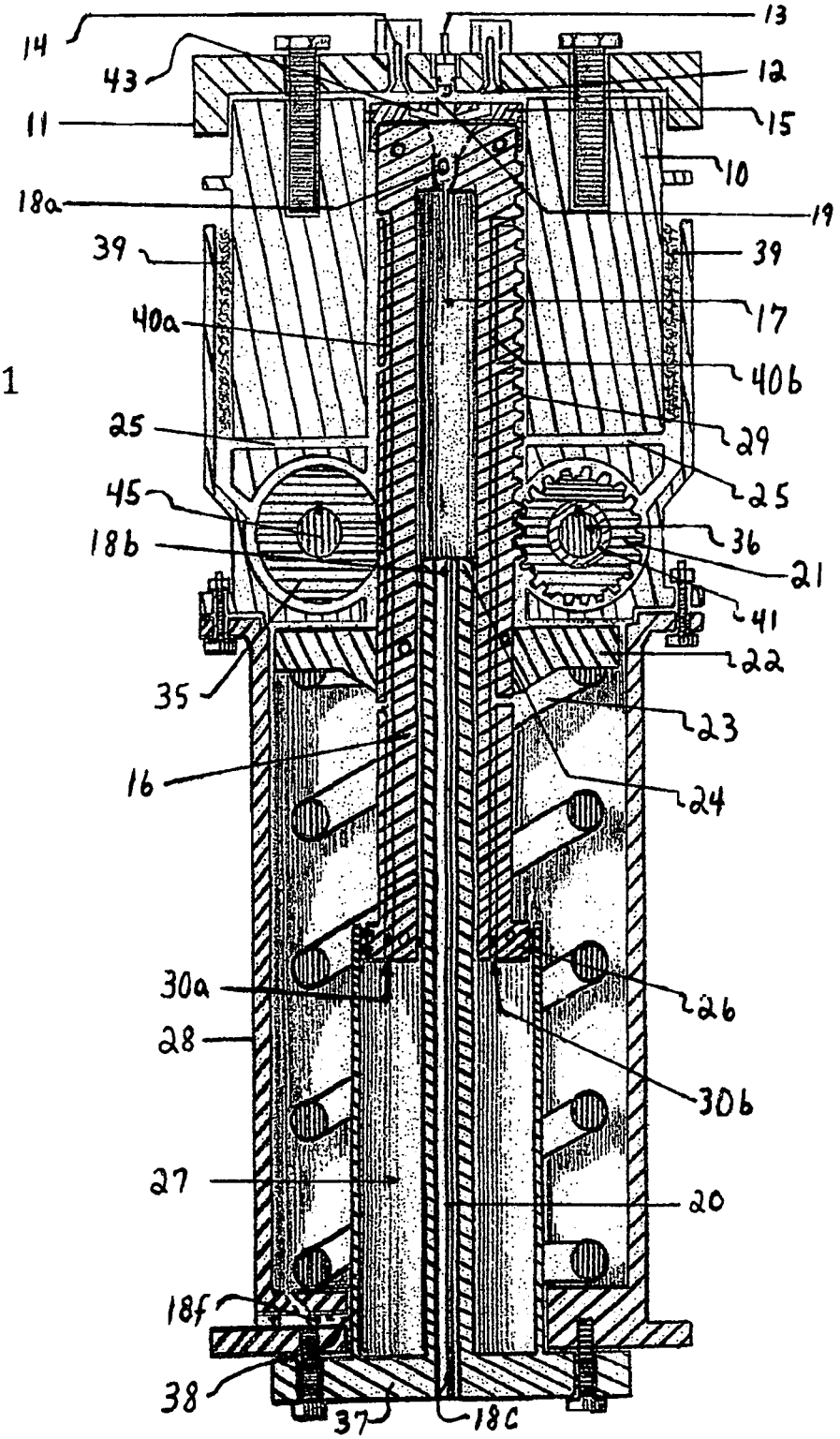
FIG. 1 is a detailed sectional view of the preferred embodiments of one Potential Energy Storage Engine prior to combustion.
Figure 2:
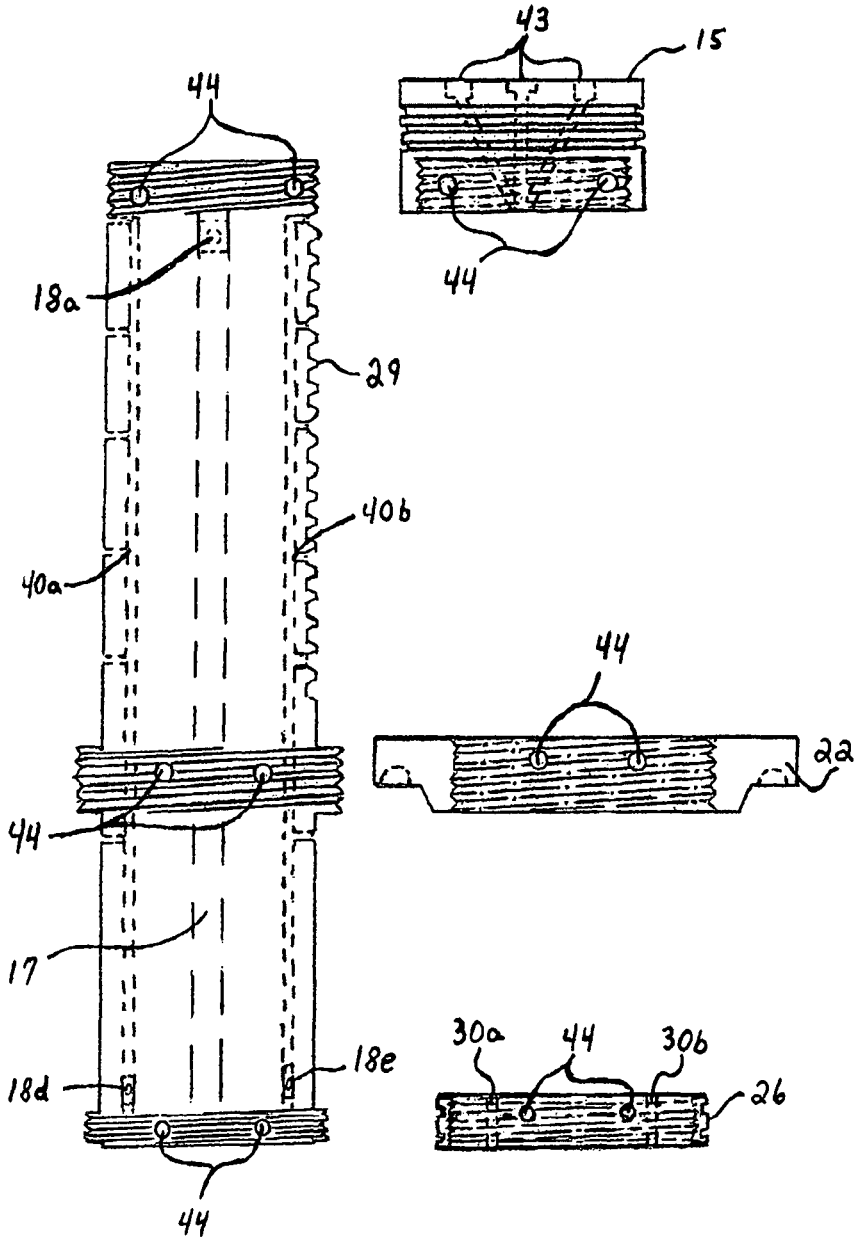
FIG. 2 illustrates the break down of the main shaft also being a rack, combustion piston, spring retainer, and oiling piston.
Figure 4:
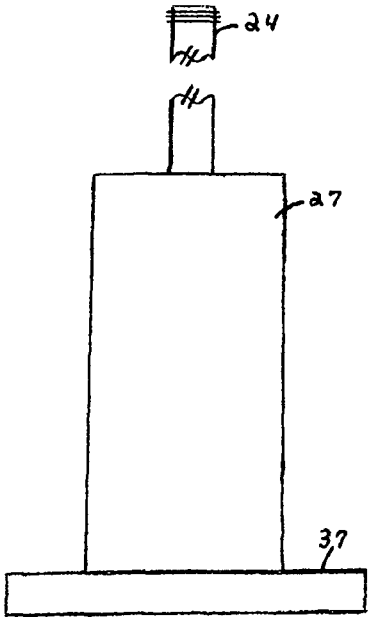
FIG. 4 is a perspective view illustrating the stationary piston, oil cylinder, and base of the engine.

The current invention is a linear internal combustion free-piston engine. It's preferred embodiments are comprised of multiple cylinders and three acting pistons per each combustion chamber. Referring to FIG. 1 the first cylinder being the combustion cylinder 10 is fastened to a head 11. In the said head 11 there are three provisions, the first being an air/fuel opening 12, the second is to hold an igniter 13, and the third for the controlled exhaust valve 14 of which all are controlled electronically by solenoids (not shown). Located interiorly to the combustion cylinder 10 is the first piston being the combustion piston 15 affixed to a main shaft 16 via threads and pins that is also a rack 29 and contains an air chamber 17. Between the head 11 and the combustion piston 15 is the combustion chamber 19. Referring to FIGS. 1 and 2 the said air chamber 17 having an opening in the bottom end of the main shaft 16 exiting the top of the said main shaft 16 and through one or multiple air jackets 43 in the combustion piston 15 and creates a second cylinder being the air chamber cylinder. The said air chamber 17, further curtailed by a check valve 18*a* at the end of the air chamber 17 that exits into the air jackets 43 of the combustion piston 15. The said rack 29 is in contact with a pinion 21. The said pinion 21 is affixed to an internal sprag clutch 41. Affixed to the bottom of the said main shaft 16 is a second piston that is the oiling piston 26 and serves as a positive displacement pump and will be further explained herein. A third piston being the stationary piston 24 is situated inside of the air chamber 17 and extends down to the base 37 of which is one unit with the stationary piston 24. The said base 37 is also one unit creating an oil cylinder 27 as illustrated in FIG. 4. The said stationary piston 24 has a through air hole 20 and check valves 18*b* and 18*c* at either end of the through air hole 20 that stay shut during the combustion cycle. The said through air hole 20 exits the top of the stationary piston 24 and through the bottom of the base 37 to the outside air. When combustion forces the combustion piston 15 and main shaft 16 with the air chamber 17 down over the stationary piston 24 air forces the check valve 18*a* open and additional air is introduced into the combustion chamber 19 during the combustion cycle. Check valves 18*b* and 18*c* open as the combustion piston 15 ascends back up toward the head 11 at which time the check valve 18*a* is shut and the outside air flows back into the air chamber 17. Again referring to FIGS. 1 and 2 illustrating that affixed to the exterior of the said main shaft 16 located beneath where the rack 29 ends on the main shaft 16 is an appendage that is threaded and having pin holes 44 for affixing it to the main shaft 16 and is round having a beveled outermost edge being a spring retainer 22. Located beneath the spring retainer 22 is an energy storage device that is a spring. For the purposes of describing the invention the energy storage device will be a compression spring 23 that in this application will be located beneath the combustion cylinder 10 inside of the body 28 but exteriorly to the bottom portion of the main shaft 16 and the oiling piston 26. The said oiling piston 26 being as one with the main shaft 16 has two oil outlets 30*a* and 30*b* and each outlet has a check valve 18*d* and 18*e* respectively. The said oil outlets 30*a* and 30*b* are openings in the head of the oiling piston 26, and the oiling piston 26 is forced further down during combustion into the oil cylinder 27 disbursing oil through the oil jackets 40*a* and 40*b* to the engine working as a positive displacement pump. The oil cylinder 27 has a provision for an oil inlet 38, which has a check valve 18*f*. Oil is held inside the body 28 creating an oil reservoir and oil is siphoned, opening the check valve 18*f*, from the oil reservoir through the said oil inlet 38 into the oil cylinder 27 as the combustion piston 15 ascends toward the head 11 at which time check valves 18*d* and 18*e* are in the closed position.

DETAILED DESCRIPTION OF THE INVENTION

Toward the bottom of said combustion cylinder 10 is an emergency relief vent 25 utilized to allow air beneath the combustion piston 15 to flow freely in and out of the combustion cylinder 10 during the combustion cycle and utilization of the stored energy cycle. The emergency relief vent 25 is also used to eliminate the possibility of an explosion and over stressing of the compression spring 23 if the combustion chamber 19 is over-fueled forcing the combustion piston 15 beyond its normal operating stroke, therefore allowing gases to escape the bottom of the combustion cylinder 10. A wire mesh filter 39 is provided to prevent oil from escaping the emergency relief vent 25 but allowing air to escape.

Figure 5:
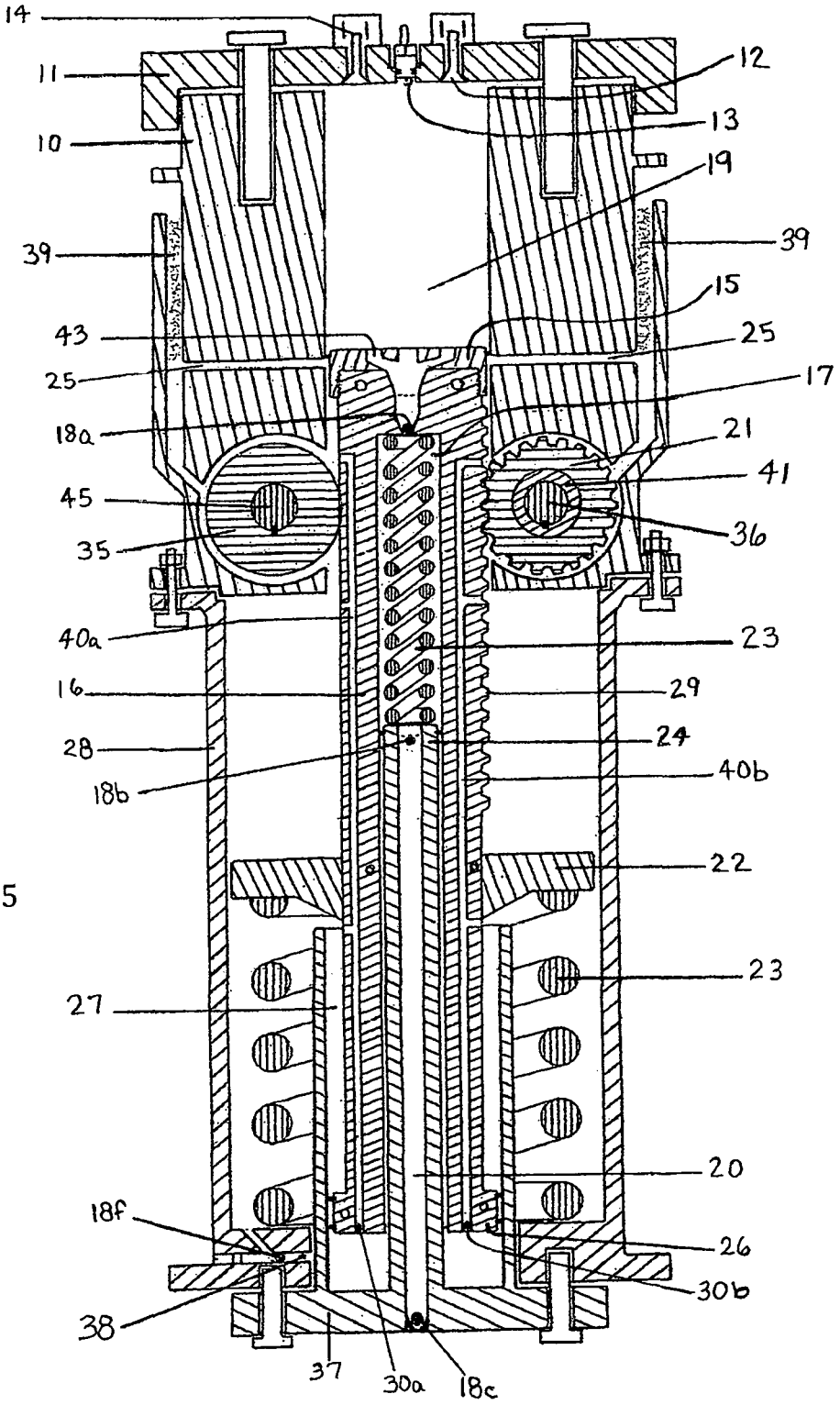
FIG. 5 is a detailed sectional view of the preferred embodiments of one Potential Energy Storage Engine during a combustion cycle using compression springs. A compression spring is seen in the air cylinder and a second compression spring is shown located exteriorly to the oil cylinder and main shaft.

Depicted in FIG. 5 is one Potential Energy Storage Engine having multiple compression springs 23 capturing energy during a combustion cycle. The compression spring 23 located within the air chamber 17 also referred to as the air cylinder, does not require a spring retainer 22 because the compression spring 23 is retained at it's first end by the top of the air chamber 17 and at the compression spring's 23 second end by the stationary piston 24. The compression spring 23 located within the air chamber 17 is compressed simultaneously with the compression spring 23 located exteriorly to the main shaft 16 and within the body 28 of the engine during a combustion cycle. All other preferred embodiments comprising the engine are as previously described.

Figure 6:
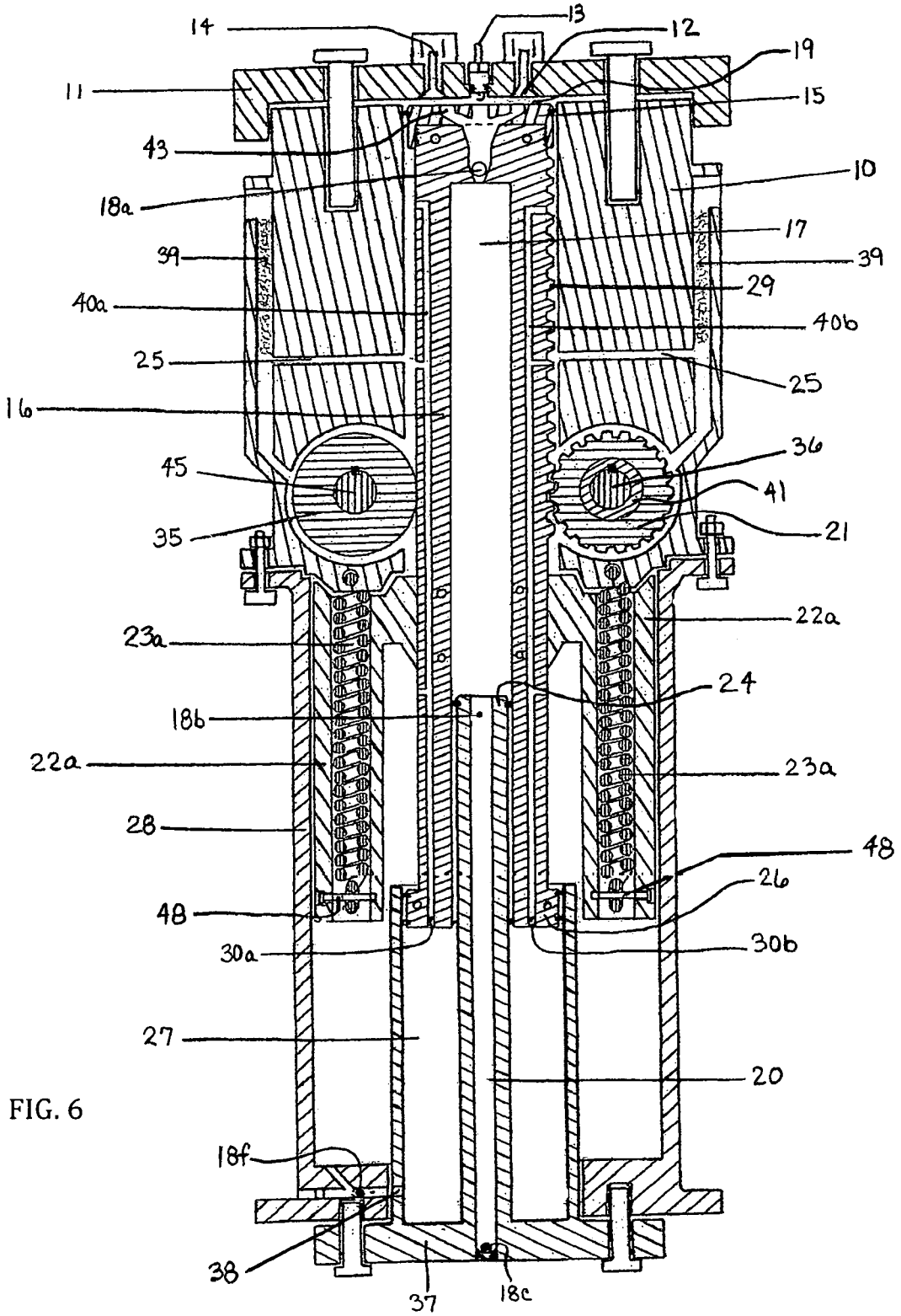
FIG. 6 is a detailed sectional view of one Potential Energy Storage Engine having multiple extension springs prior to combustion.
Figure 7:
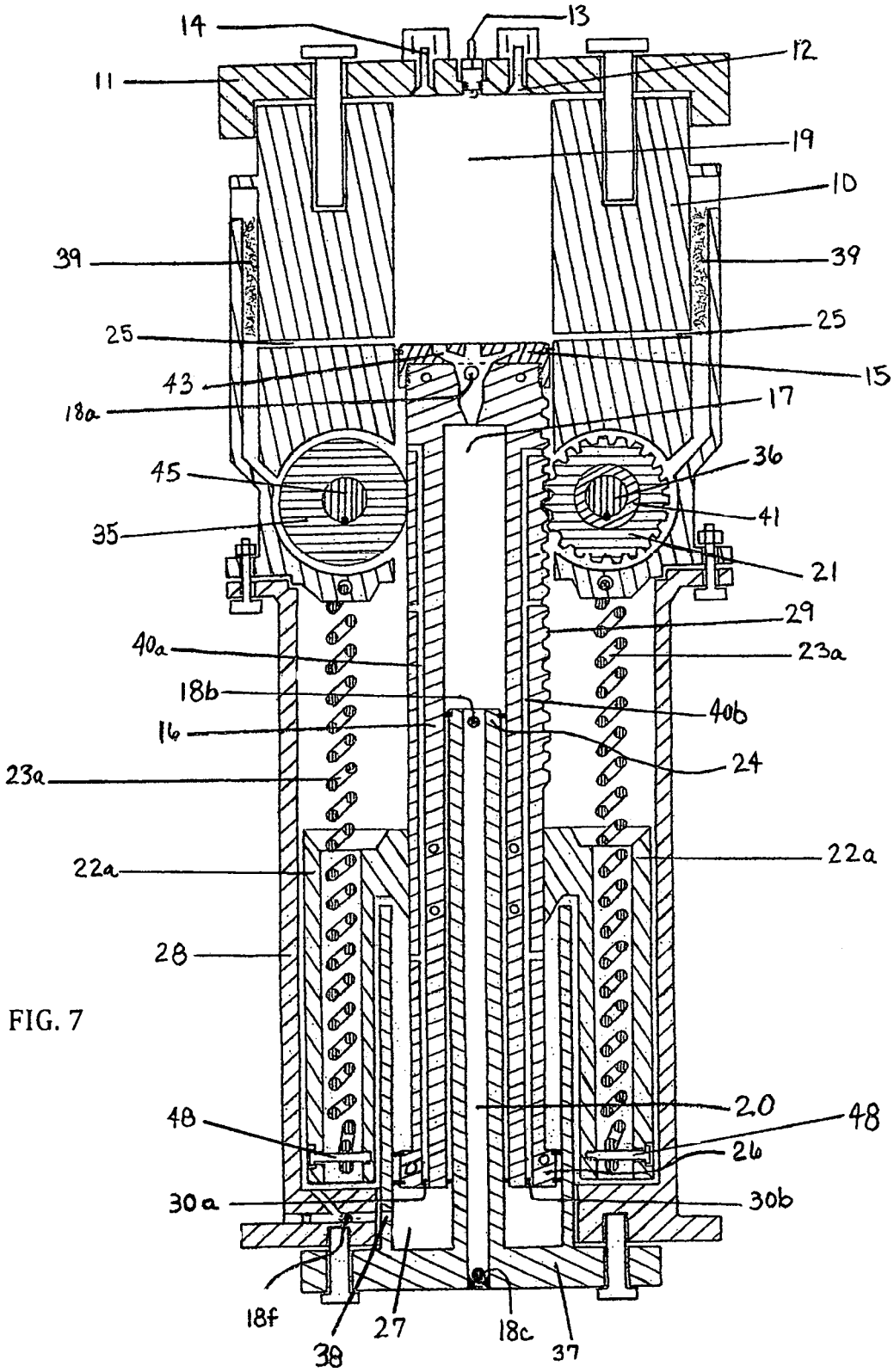
FIG. 7 is a detailed sectional view of one Potential Energy Storage Engine utilizing multiple extension springs after a combustion cycle and utilization of the emergency relief vent due to over fueling in the combustion chamber.

Now referring to FIGS. 6 and 7 wherein multiple extension springs 23*a* are illustrated in detailed sectional views of the Potential Energy Storage Engine. FIG. 6 shows the engine prior to combustion wherein the extension springs 23*a* are unextended. The extension springs 23*a* are located exteriorly to the main shaft 16 and interiorly of the body 28 of the engine. The extension springs 23*a* are retained by spring retainers 22*a*, adapted to be in an engine application wherein the preferred embodiment is an extension spring 23*a*. FIG. 7 depicts a detailed sectional view of on Potential Energy Storage Engine after a combustion cycle wherein the extension springs 23*a* are extended and harnessing energy. A first end of the extension spring 23*a* is affixed to the bottom of the combustion cylinder 10 and the extension spring's 23*a* second end is affixed via pins 48 to the bottom of the spring retainer 22*a* that is adapted for use with the extension spring 23*a*. The spring retainer 22*a* for the extension spring 23*a*, is attached to the main shaft 16 at the spring retainer's 22*a* first end via threads and pins and is at least as long as the extension spring 23*a*. FIG. 7 depicts the emergency relief vent 25 being utilized due to over fueling of the combustion chamber 19. It can be seen in FIGS. 6 and 7 that the extension spring 23*a*, spring retainer 22*a* and pins 48 are the only embodiments that differ from the previously described engine embodiments that utilized the compression spring 23.

Figure 8:
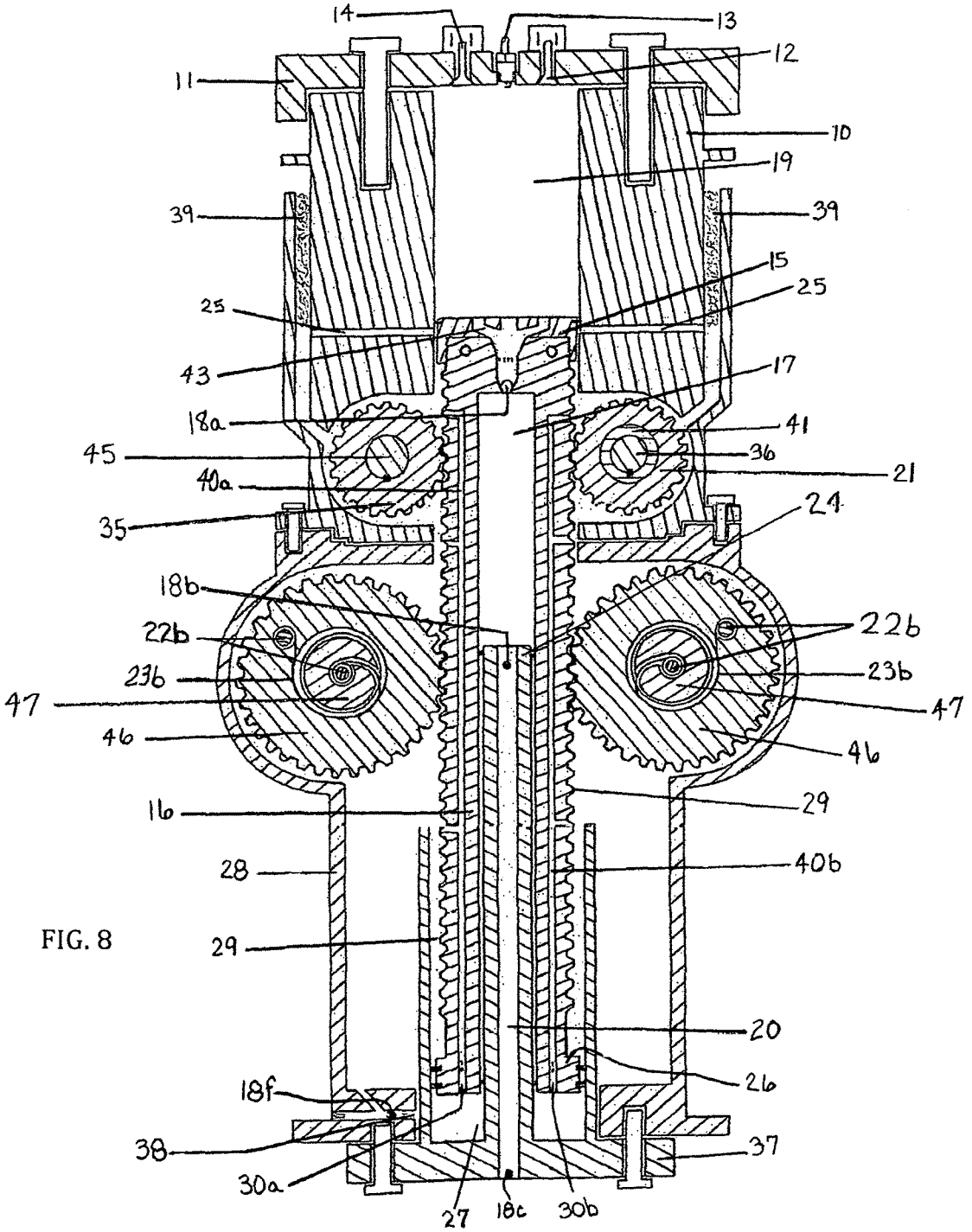
FIG. 8 is a detailed sectional view of one Potential Energy Storage Engine utilizing torsion springs after a combustion cycle.

FIG. 8 illustrates a Potential Energy Storage Engine wherein torsion springs 23*b* are the preferred energy storing springs. Depicted in FIG. 8 are two torsion springs 23*b* located exteriorly to the main shaft 16 and interiorly of the body 28 of the engine and on opposing sides of the mainshaft 16. In this application, the mainshaft 16 is adapted as having two racks 29 on opposing sides of the mainshaft 16. Located interiorly to the body 28 and beneath the pinion 21 and idler 35 are two gears 46 on opposing sides of the mainshaft 16. The gears 46 are in contact with the racks 29 on the mainshaft 16. The gears 46 are affixed on gear support shafts 47. FIG. 8 shows a detailed sectional view of on Potential Energy Storage Engine after a combustion cycle wherein the torsion springs 23*b* are torqued and harnessing energy. The torsion springs 23*b* are located around the gear support shafts 47 where the gear support shafts 47 are stationary. A first end of the torsion spring 23*b* is affixed to the gear 46 via torsion spring retainer 22*b* that is a bolt and a second end of the torsion spring 23*b* is affixed to the gear support shaft 47 via torsion spring retainer 22*b* that is a bolt. During a combustion cycle, as the mainshaft 16 with dual racks 29 is thrust downward, the gears 46 rotate causing the torsion springs 23*b* to be torqued around the gear support shaft 47. As seen in FIG. 8 the torsion springs 23*b*, torsion spring retainers 22*b*, gears 46, and gear support shaft 47 are the only embodiments that differ from the embodiments of a Potential Energy Storage Engine utilizing compression springs 23 or extension springs 23*a*.

Figure 3:
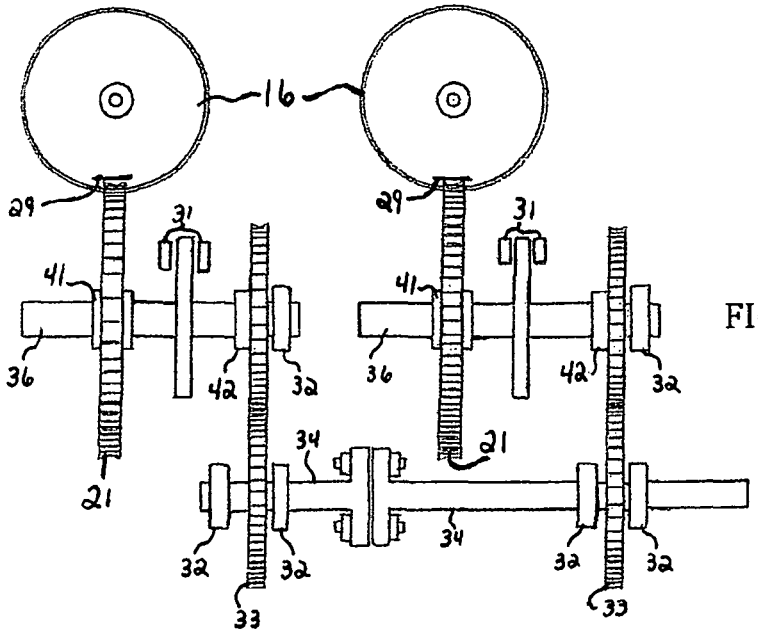
FIG. 3 is a top view illustrating the top of the main shaft with the rack contacting the pinion and how two independent engines transfer energy on the same driveshaft.

In FIG. 3 two engines are illustrated transferring energy to one drive shaft 34. Where each engine has a jackshaft 36 that is affixed in an internal sprag clutch 41 and the said internal sprag clutch 41 is affixed interiorly to the pinion 21. With the jackshaft 36 extending out of the engine supported by support bearings 32 and the jackshaft 36 having a brake system 31 attached that is utilized to hold the jackshaft 36 from turning until energy is required to do work. Also affixed to the jackshaft 36 is an external sprag clutch 42 that is in contact with the drive gear 33 that is affixed on the driveshaft 34. The said drive shaft 34 is also supported by support bearings 32.

Another preferred embodiment is a means for the exhaust pressure to be channeled from the controlled exhaust valve 14 into a chamber (not shown) that forces air pressure to build in a compressor (not shown). As the compressor reaches the desired pressure the exhaust gases are released to outside air. The compressed air is then used to force an air/fuel mixture (not shown) into the combustion chamber 19 at a desired PSI and is controlled electronically by way of solenoid (not shown).

Having clearly and concisely described the preferred embodiments that comprise the present invention, I will briefly explain the process of how the preferred embodiments function in the present invention. With the aforementioned combustion piston 15 having tension on it creating compression provided by the compression spring 23, extension spring 23*a*, or torsion spring 23*b* and in its upward most position near the head 11, an air/fuel mixture is pressurized into the combustion chamber 19 by way of solenoid to the desired compression ratio. Also controlled via solenoid, the igniter 13 is sparked beginning the combustion cycle forcing the combustion piston 15, main shaft 16 also being a rack 29, and oiling piston 26 all being one unit, downward. Therefore the air chamber 17 with open check valve 18*a* is thrusting additional air up through the combustion piston 15 into the air jackets 43 out into the combustion chamber 19 as the main shaft 16 is forced down by combustion onto the stationary piston 24 with check valves 18*b* and 18*c* in the stationary piston 24 being closed. Forcing additional air into the combustion chamber 19 during the combustion cycle causes a more complete burn of the fuel and helps maintain a static pressure after the combustion piston 15 has finished its downward stroke. Combustion also forces the spring retainer 22, 22*a* or 22*b* to compress, extend or torque the compression spring 23, extension spring 23*a* or torsion spring 23*b* and at the same time forces the oiling piston 26 to plunge deeper into the oil cylinder 27 sending oil through both oil outlets 30*a* and 30*b* and open check valves 18*d* and 18*e* disbursing lubricant through the oil jackets 40*a* and 40*b* to the engine components. Additionally as combustion forces the combustion piston 15 and the main shaft 16 also being a rack 29 downward, the pinion 21 is affixed to an internal sprag clutch 41 which is affixed to the jackshaft 36 that allows for slip and the jackshaft 36 does not rotate. The main shaft 16 is stabilized by an idler 35 that is affixed to an idler support shaft 45 and the rack 29 guided by being in contact with the said pinion 21 keeping the entire main shaft 16 unit square within the combustion cylinder 10 during all movement. With the said jackshaft 36 extending out of the combustion cylinder 10, in FIG. 3 the illustration shows the rack 29 in contact with the pinion 21 that is affixed to an internal sprag clutch 41. As combustion drives the combustion piston 15 downward, the rack 29 rotates the pinion 21 and the internal sprag clutch 41 allows the jackshaft 36 to remain motionless while the brake system 31 is engaged on the jackshaft 36 and energy is stored in the compression spring 23, extension spring 23*a*, or torsion spring 23*b* during the combustion cycle. When energy is required the brake system 31 is released and the jackshaft 36 transfers energy to the external sprag clutch 42 as the compression spring 23, extension spring 23*a* or torsion spring 23*b* forces the combustion piston 15 upward toward the head 11. The external sprag clutch 42 in now engaged and rotates the drive gear 33 which rotates the drive shaft 34. Where there is more than one engine connected to the same drive shaft 34 the external sprag clutch 42 of a first engine allows for slipping while the brake system 31 is engaged on its jackshaft 36 and the opposing engine's brake system 31 is disengaged and external sprag clutch 42 is engaged driving its drive gear 33 and rotating the drive shaft 34. Multiple engines can perform work simultaneously while opposing multiple engines are braked waiting to perform work all attached to the same drive shaft 34.

It should be noted that this engine can be assembled in multiple sequences depending upon application. For example the compression spring 23 could also be located interiorly in the air chamber 17 in which case the said spring retainer 22 would be omitted and the bottom of the combustion piston 15 would act as a spring retainer. It should also be noted that multiple compression springs 23, extension springs 23*a*, or torsion springs 23*b* can be used and arranged around the exterior of the oil cylinder 27 but housed by the body 28 and so on. Additionally, other attributes of the present invention that should be noted are its ability to self-start and to use the compression spring 23, extension spring 23*a*, or torsion spring 23*b* to create tension on the combustion piston 15 allowing the air/fuel mixture to be pressurized into the combustion chamber 19 to a desired PSI and eliminating the compression stroke. Furthermore this engine does not idle, and by adding additional air into the combustion chamber 19 during the combustion cycle, the length of the combustion cycle is directly affected creating more efficient and complete fuel combustion. The design of the current invention allows for a longer combustion piston 15 stroke providing the ability to harness additional energy per combustion cycle, and while the combustion may be hotter, storing the energy on the compression spring 23, extension spring 23*a*, or torsion spring 23*b* allows additional time for cooling, and the compression spring 23, extension spring 23*a*, or torsion spring 23*b* can be adjusted for more or less torque if desired.

While the present invention has been explained by reference to the preferred embodiments described above, it will be appreciated that these embodiments are only examples provided to illustrate the present invention and are not meant to be restrictive on the spirit and scope of the present invention. This invention should be determined from the general principles and spirit of the invention as described above. Variations and modifications which are obvious to those skilled in the art including improvements made on the basis of the present invention, should be considered as falling within the scope of the present invention. Furthermore, it should be appreciated that the present invention can be assembled in multiple sequences and can be utilized in many applications, including but not limited to multiple engines married utilizing stored energy on a single shaft as one unit.

What is claimed is:

1. A linear combustion engine comprising:

three cylinders, a first cylinder is a combustion cylinder having a wall, a head attached at the combustion cylinder first end and a distal end of the combustion cylinder being is attached to a body, with a combustion chamber beneath the head, where;

a second cylinder is an air cylinder that is a main shaft with one end located interiorly to the combustion cylinder and a distal end of the main shaft located interiorly of a third cylinder, having a wall and both ends defined by attached opposing pistons and is further defined as a rack, the third cylinder is a oil cylinder having a wall and is open at the oil cylinder top end and closed at the oil cylinder distal end by a base of the engine, where the oil cylinder is defined as one unit with the base of the engine; and having three acting pistons, where a first piston is a combustion piston that has at least one provision in the combustion piston head is an air jacket that is a through opening to the air cylinder, and is located in the combustion cylinder beneath the head having the combustion chamber above the combustion piston; and a second piston is a stationary piston that extends from the base of the engine through the center of the oil cylinder where the stationary piston is also one unit with the base, and the stationary piston head is located within the air cylinder and is defined by having a through air hole with one opening in the stationary piston head and an other opening where the stationary piston is one with the base open to outside air; and a third piston is an oiling piston that is attached to the distal end of the main shaft and is located within the oil cylinder and is opposing the combustion piston, where the oiling piston has two provisions in the oiling piston head, further defined as oil outlets; and having at least one spring that is used as an energy storing device where the energy created by combustion is stored on the spring and the spring is held until energy is required; and having a controlled exhaust valve that does not open immediately after combustion but opens only as the spring is released to preform work.

2. The linear combustion engine in claim 1 wherein;

the combustion cylinder houses a pinion that is affixed to an internal sprag clutch; and the internal sprag clutch is affixed to a jackshaft that extends out of the combustion cylinder; and the pinion and internal sprag clutch are located near a bottom side of the combustion cylinder; and on an opposing side near the bottom of the combustion cylinder an idler is housed.

3. The linear combustion engine in claim 1 wherein:

the combustion piston, stationary piston, and oiling piston assemblies all include a piston and piston seals; and the combustion piston and oiling piston are affixed to the main shaft via threads and pins; and all three pistons are acting pistons per each combustion chamber.

4. The linear combustion engine in claim 1 wherein:

the combustion piston air jacket is further defined by having an open check valve during a combustion cycle and a closed check valve while the spring is allowed to uses spring's stored energy for work; and the air jacket is a passage for air forced into the combustion chamber during a combustion cycle as the stationary piston forces air from the air cylinder into the air jackets of the combustion piston; and a fuel is more completely combusted in the combustion chamber; and a static pressure in the combustion chamber is higher because of additional air in the combustion chamber after a combustion cycle is complete.

5. The linear combustion engine in claim 1 wherein:

the stationary piston is further defined by having two check valves; and the check valves are located one in the head of the stationary piston and the other at the distal end of the stationary piston in the base of the engine; and the check valves are shut during a combustion cycle and open as the energy stored on the spring is released forcing the combustion piston upward toward the head; and the open check valves allow outside air to be siphoned back into the air cylinder through the through hole of the stationary piston.

6. The linear combustion engine in claim 1 wherein:

the oiling piston having two provisions that are oil outlets; and the oil outlets each having a check valve; and the check valves are open during a combustion cycle allowing lubricant into the oil outlets during a combustion cycle; and the lubricant is forced through the oil outlets into oil jackets that are located in the main shaft disbursing lubricant through out the engine; and the check valves in the oil outlets are closed as the energy stored on the spring is released forcing the combustion piston upward toward the head; and the oil piston acts as a positive displacement pump during a combustion cycle.

7. The linear combustion engine in claim 1 wherein:

the oil cylinder is further defined by having a provision near the bottom for an oil inlet; and the oil inlet is further defined by having a check valve that is closed during a combustion cycle and open as energy stored on the spring is released forcing the combustion piston upward toward the head.

8. The linear combustion engine in claim 1 wherein:

the oil cylinder and spring are housed by a body of the engine; and the body of the engine having walls and having an end located under and attached to the combustion cylinder and the distal end of the body, located above and attached to the base; and the body is further defined as being an oil reservoir; and the lubricant is siphoned into the oil cylinder from the oil reservoir when energy stored on the spring is released forcing the combustion piston upward toward the head.

9. The linear combustion engine in claim 1 wherein:

the main shaft has a spring retainer affixed on the exterior of the main shaft via threads and pins; and the spring retainer is located on the main shaft beneath the combustion cylinder in the body of the engine; and the spring retainer is always in contact with the spring.

10. The linear combustion engine in claim 1 wherein:

an air/fuel mixture is pressurized into the combustion cylinder by way of compressor; and the compressor is pressurized by exhaust pressure that is released as the energy stored on the spring is utilized forcing the combustion piston upward toward the head and the exhaust valve is opened electronically by solenoid; and the combustion chamber is pressurized to a desired PSI by the compressor; and the compressor can be pressurized electronically; and the spring holds tension on the main shaft holding the combustion piston in place while the air/fuel mixture is pressurized into the combustion chamber until ignited or if desired until self-ignition takes place.

11. The linear combustion engine in claim 1 wherein:

a jackshaft extending out of the engine has a brake engaged during a combustion cycle; and the spring having stored energy can not perform work until the brake is released; and the jackshaft is further defined as having an external sprag clutch affixed to it the jackshaft located on the exterior of the engine that is in contact with a drive gear that is affixed to a drive shaft; and the jackshaft and the drive shaft having each having support bearings.

12. The linear combustion engine in claim 1 wherein:

the engine's preferred embodiments can be assembled in multiple sequences for use in different applications.

13. The linear combustion engine in claim 1 wherein:

the spring that is used as the energy storage device is further defined as compression, torsion, or extension; and a compression, torsion, or extension spring can collect energy located exteriorly to the oil cylinder and main shaft and beneath a spring retainer in the body; and a compression spring can collect energy located interiorly to the air cylinder in which application the spring retainer would be omitted; and the compression spring would be retained between the top of the air cylinder and the stationary piston; and the where compression, torsion, or extension springs, can collect energy being in multiples arranged in the body of the engine around the oil cylinder and main shaft and beneath the spring retainer.

14. The linear combustion engine in claim 1 wherein:

the engine easily connects in multiples having energy transferred to a same single drive shaft; and multiple engines each having their own independent timing and energy stored in their spring operate independently of one another and do not release energy until required and can drive the same drive shaft independently or collectively.

* * * * *